United States Patent [19]

Cringuette et al.

[11] Patent Number: 5,040,949

[45] Date of Patent: Aug. 20, 1991

[54] TWO STAGE DRY PRIMARY PUMP

[75] Inventors: Jean-Marie Cringuette, Annecy le Vieux; Jacques Long, Annecy, both of France

[73] Assignee: Alcatel Cit, Paris, France

[21] Appl. No.: 531,726

[22] Filed: Jun. 1, 1990

[30] Foreign Application Priority Data

Jun. 5, 1989 [FR] France ..... 89 07392

[51] Int. Cl.[5] ..... F04B 3/00; F04B 23/08; F04B 49/00; F01C 21/04

[52] U.S. Cl. ..... 417/205; 417/251; 417/310; 418/83; 415/90

[58] Field of Search ..... 417/201, 205, 244, 251, 417/310, 426, 428; 415/90; 418/83, 88

[56] References Cited

U.S. PATENT DOCUMENTS 2,903,248 9/1959 Walker ..... 417/426
3,642,384 2/1972 Huse .
4,042,310 8/1977 Schibbye et al. ..... 417/310
4,090,815 5/1978 Nakamura .
4,770,609 9/1988 Uchida et al. .
4,781,553 11/1988 Nomura et al. ..... 418/201.1
4,797,068 1/1989 Hayakawa et al. ..... 417/201

FOREIGN PATENT DOCUMENTS 0256234 2/1988 European Pat. Off. .
3711143 10/1987 Fed. Rep. of Germany .

*Primary Examiner*—Leonard E. Smith
*Assistant Examiner*—Alfred Basichas
*Attorney, Agent, or Firm*—Sughrue, Mion, Zinn, Macpeak & Seas

[57] ABSTRACT

A two stage dry primary pump comprises, in a single common stator: a screw pump at its low pressure end; and a fluid viscous effect, single rotary screw gas exhaust pump at its high pressure end; with a link duct providing communication between the screw pump and the viscous effect, single rotary screw gas exhaust pump. The invention is applicable to vacuum pumps.

6 Claims, 2 Drawing Sheets

TWO STAGE DRY PRIMARY PUMP

The present invention relates to a two stage dry primary pump.

BACKGROUND OF THE INVENTION

Two stage dry primary pumps are known with each stage generally being constituted by a vane pump. Compared with an oil-lubricated vane pump, a dry vane pump avoids oil vapor migrating into the enclosure to be evacuated, but the main drawback lies in the existence of major dry friction giving rise to rapid wear and accelerated reduction in performance.

Screw type dry primary pumps are also known which are constituted by a single stage. Under steady conditions, such pumps are capable of pumping a fluid from a limiting inlet pressure of about $10^{31\ 2}$ mbar up to atmospheric pressure. They have the advantage of no contact between the screws and thus no friction, and this makes them very reliable. However, in that portion of the pump where the pressure is greater than 10 mbar they absorb high power and the absorbed power is dissipated mainly as heat. The portions of the screws operating in this high pressure zone (pressures higher than 10 mbar) are therefore subjected to considerable heating which gives rise to major asymmetrical expansion that is incompatible with internal clearance. Increasing the clearance between the two screws is not a satisfactory solution since performance is no longer ensured under such conditions, in particular with respect to pumped throughout and to limiting pressure.

The object of the present invention is to provide a solution to this problem, i.e. to obtain a dry primary pump capable, under steady conditions, of sucking a fluid from a limiting pressure of about $10^{31\ 2}$ mbar. or even less, and of delivering it at atmospheric pressure, while offering a wide range of pumping rates, from 50 $m^3/h$ to a few thousand $m^3/h$.

SUMMARY OF THE INVENTION

The invention consists in limiting the delivery pressure of the screw pump so as to limit heating thereof, and in adding a second stage constituted by a viscous effect, single rotary screw gas exhaust pump enabling such compression energy as is degraded into heat to be confined to the second stage. The screw pump therefore no longer includes a portion operating at high pressures and subjected to major expansion. In addition, in the range of pressures over which the screw pump operates ($10^{31\ 2}$ mbar to 10 mbar), the mean free path of molecules is relatively high and this pump can therefore operate with larger internal clearances. Such larger internal clearances enable the cost of the srew pump to kept down, thereby keeping down the total cost of the primary pump.

The present invention therefore provides a two stage dry primary pump comprising, in a single common stator: a screw pump at its low pressure end; and a fluid viscous effect, single rotary screw gas exhaust pump at its high pressure end; with a link duct providing communication between the screw pump and the viscous effect, single rotary screw gas exhaust pump.

In a first embodiment, the link duct is in communication with the suction end of the screw pump, i.e. the suction end of the primary pump, via a bypass provided with a discharge valve.

In a second embodiment, the link duct is in communication with the delivery end if the viscous effect, single rotary screw gas exhaust pump, i.e. the delivery end of the primary pump, via a bypass provided with a discharge valve.

Preferably, the primary pump includes both of these embodiments.

Depending on the geometry, the dimensions, the clearances, the volume of the enclosure to be evacuated, and the time available for reducing, the stages may have different speeds of rotation. A single motor may drive the screw pump and the viscous effect, single rotary screw gas exhaust pump simultaneously, or else two motors may drive the screw pump and the viscous effect, single rotary screw gas exhaust pump independently. In particular in applications where pressure regulation is not required, independent drive serves to vary the speeds of rotation independently, thereby varying pumping speeds.

The, or each, motor may be a conventional motor or a motor having its rotor in vacuo.

BRIEF DESCRIPTION OF THE DRAWINGS

Two embodiments of the invention are described by way of example with reference to the accompanying drawings, in which.

DETAILED DESCRIPTION

Figure 1:
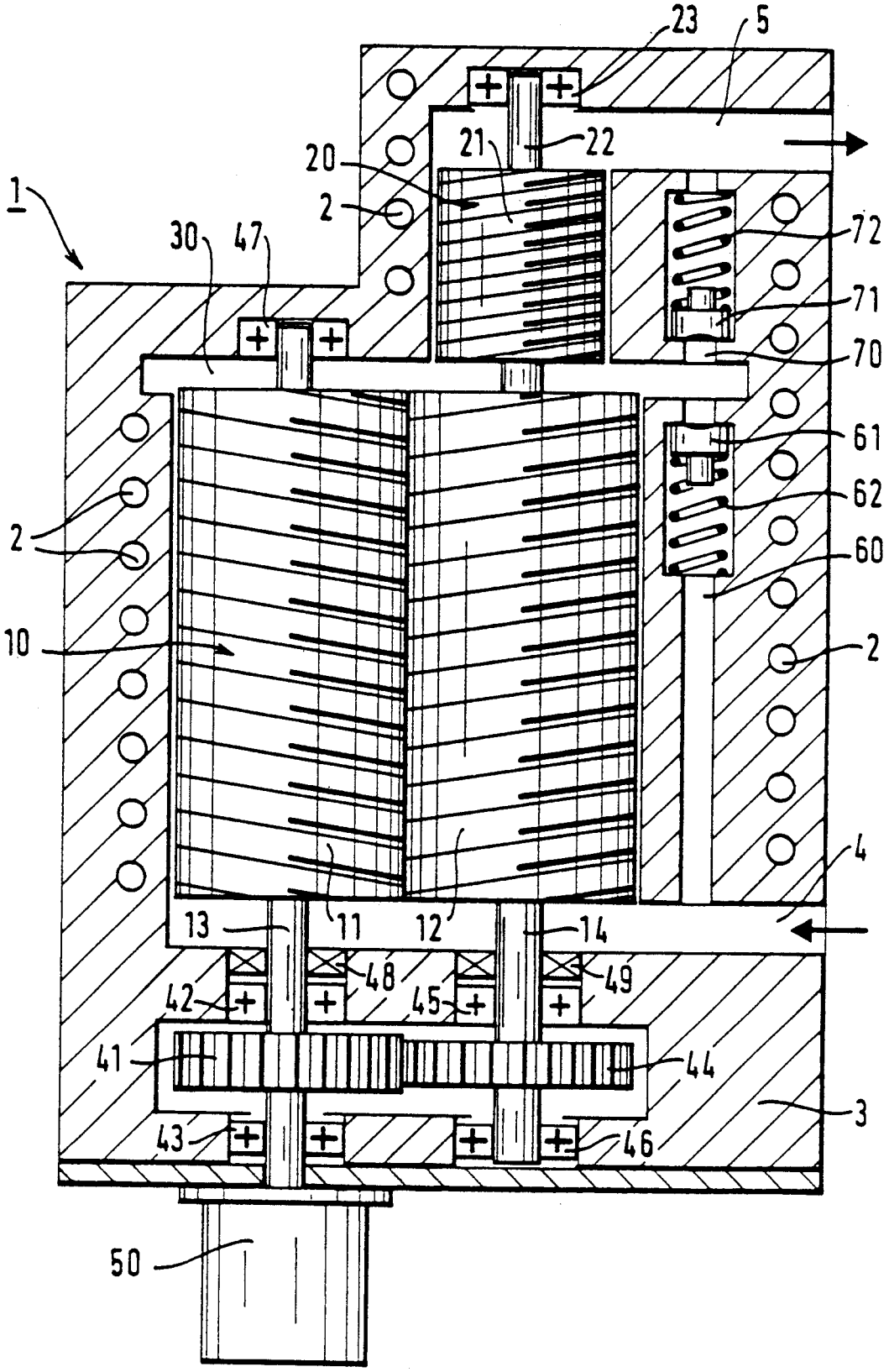
FIG. 1 shows a pump provided with a single motor.

In FIG. 1, the primary pump comprises a body 1 constituting a stator, a suction inlet 4, a delivery outlet 5, a low pressure stage constituted by a dry screw pump 10, and a high pressure stage constituted by a viscous effect, single rotary screw gas exhaust pump 20. The body 1 may include cooling passages 2 serving to convey a cooling liquid (water, oil, . . .) for stabilizing the temperature of the assembly. Heat exchange with the surrounding medium may be forced or natural convection.

The pump 10 includes two conjugate screws 11 and 12 mounted on respective shafts 13 and 14 and driven synchronously by means of two gear wheels 41 and 44, with the gear wheel 41 being driven by an electric motor 50. Both gear wheels 41 and 44 are mounted in an oil box 3 which is fixed to or integral with the body 1 and which is sealed from the suction inlet 4 by two seals 48 and 49. The two shaft 13 and 14 rotate in respective pairs of bearings 42 & 43 and 45 & 46. The shaft 13 rotates in a further bearing 47 situated at its other end level with a link duct.

The pump 20 is a viscous effect, single rotary screw gas exhaust pump, i.e. a pump in which the pumping effect is obtained by friction from a rotor/stator assembly 21 having a screw with one or more varying pitch helical grooves of profile varying between the suction end and the delivery end, and rotating at high speed. The pump 20 as shown is cylindrical, but naturally it could be in the form of a disk or a cone, for example.

In FIG. 1, the shaft 22 of the pump 20 is mechanically connected to the shaft 14 of the screw 12 such that the motor 50 serves to drive the rotary screws of both pumps 10 and 20. The shaft 22 rotates in a bearing 23.

The primary pump includes two bypasses 60 and 70 each of which is fitted with a discharge valve 61 or 71, said bypasses serving to distribute fluid flows during transient stages.

The bypass 60 allows excess gas pumped by the low pressure stage to be recycled back to the suction inlet 4, while the bypass 70 allows excess gas to be recycled to the delivery outlet 5.

The valves 61 and 71 may either be controlled or else they may be automatic, and they may either close under yrging from a corresponding spring 62, 72 (as shown), or else they may close under the effect of their own weight. However, in either case, they are closed when the flow rate delivered by the low pressure stage is compatible with the flow rate sucked in by the high pressure stage.

Figure 2:
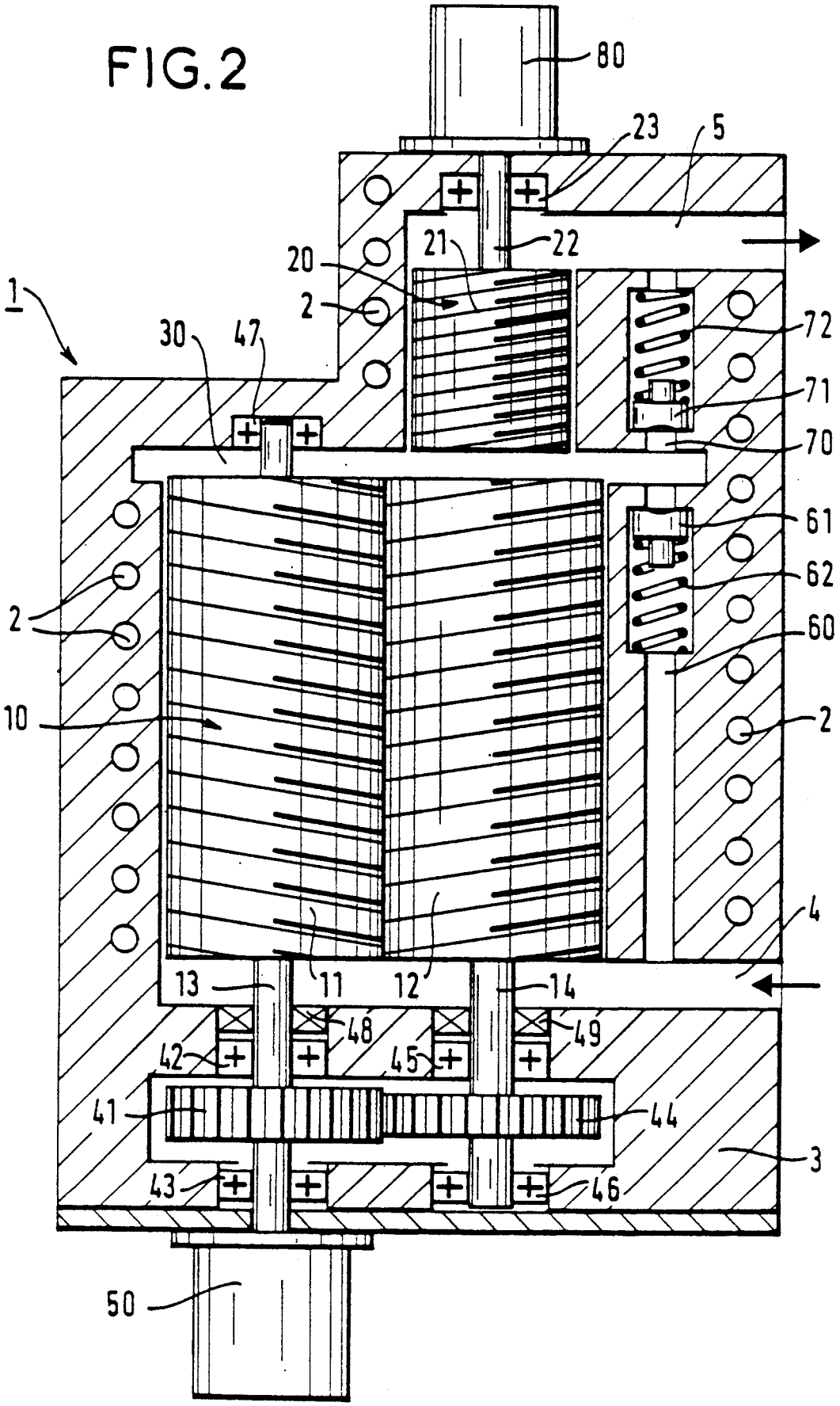
FIG. 2 shows a pump provided with two motors.

In FIG. 2, the pump 20 is driven separately by an electric motor 80, and in this case the shaft 22 of the pump 20 is no longer connected to the shaft 14 of the screw 12, but is instead connected to the electric motor 80.

The deposition shown in FIG. 2 makes it possible for the speed of rotation of the pump 20 to be different from that of the screw pump 10 The speed of rotation of the pump 20 can therefore be readily adapted to the delivery rate and pressure from the pump 10. With this type of viscous effect, single rotary screw gas exhaust pump, the volume throughout is low, because of the high compression ratio obtained by the first stage.

Such a primary pump operates as follows:

When starting, i.e. while the enclosure is being emptied, the excess pressure set up at the outlet from the low pressure stage causes both valves 61 and 71 to open.

As soon as the throughput of the high pressure stage becomes adequate, the valve 71 closes while the valve 61 remains open.

As soon as the throughput of the low pressure stage matches the throughput of the high pressure stage, the valve 61 closes and the primary pump then operates under steady conditions.

We claim:

1. A two stage dry primary pump comprising, in a single common stator: a screw pump at its low pressure end; and a viscous effect, single rotary screw gas exhaust pump at its high pressure end; and a link duct providing communication between the screw pump and the viscous effect, single rotary screw gas exhaust pump.

2. A two stage dry primary pump according to claim 1, wherein link duct is in communication with the suction end of the screw pump via a bypass provided with a discharge valve.

3. A two stage dry primary pump according to claim 1, wherein the link duct is in communication with the discharge end of the viscous effect, single rotary screw gas exhaust pump via a bypass provided with a discharge valve.

4. A two stage dry primary pump according to claim 1, wherein a single motor drives both the screw pump and the viscous effect, single rotary screw gas exhaust pump.

5. A two stage dry primary pump according to claim 1, wherein two distinct motors drive respectively, the screw pump and the viscous effect, single rotary screw gas exhaust pump.

6. A two stage dry primary pump according to claim 1, further including cooling passages within the common strator for circulating a cooling liquid through said strator.

* * * * *